United States Patent [19]

Eguchi et al.

[11] Patent Number: 4,855,609

[45] Date of Patent: Aug. 8, 1989

[54] STARTER FOR INTERNAL COMBUSTION ENGINE

[75] Inventors: Hitoshi Eguchi; Motoaki Kuribara; Tugio Onodera; Koji Kobayashi, all of Gumma; Ikuo Fujino, Ashikaga; Hiroshi Hagiwara, Isesaki; Seiichi Ogino, Kiryu, all of Japan

[73] Assignee: Mitsuba Electric Mfg. Co., Ltd., Japan

[21] Appl. No.: 169,330

[22] Filed: Mar. 17, 1988

[30] Foreign Application Priority Data

| | | | |
|---|---|---|---|
| Mar. 18, 1987 | [JP] | Japan | 62-63240 |
| Mar. 18, 1987 | [JP] | Japan | 62-39554[U] |
| Mar. 18, 1987 | [JP] | Japan | 62-39555[U] |
| Mar. 18, 1987 | [JP] | Japan | 62-39556[U] |
| Mar. 18, 1987 | [JP] | Japan | 62-39557[U] |

[51] Int. Cl.[4] ..... F02N 15/06

[52] U.S. Cl. ..... 290/48; 290/38 C

[58] Field of Search ..... 290/38 R, 38 C, 48, 290/DIG. 1; 74/7 R, 7 A, 9

[56] References Cited

U.S. PATENT DOCUMENTS

| | | | |
|---|---|---|---|
| 2,302,680 | 11/1942 | Dyer | 290/37 |
| 4,319,139 | 3/1982 | Mazzorana | 290/38 C |

FOREIGN PATENT DOCUMENTS

| | | |
|---|---|---|
| 60-30364 | 3/1985 | Japan . |
| 61-112774 | 5/1986 | Japan . |
| 61-138877 | 6/1986 | Japan . |
| 62-150073 | 7/1987 | Japan . |

*Primary Examiner*—William M. Shoop, Jr.
*Assistant Examiner*—W. E. Duncanson, Jr.
*Attorney, Agent, or Firm*—Darby & Darby

[57] ABSTRACT

The present invention discloses a starter for starting an internal combustion engine which comprises:

(a) a starter motor having a starter shaft;

(b) a pinion gear splined to the starter shaft so as to be slidable along the starter shaft for connection and disconnection of the starter motor to the engine;

(c) a shifting motor having a shifting shaft;

(d) a sliding means helical splined to the shifting shaft for a reciprocal movement along the shifting shaft according to a rotational movement of the shifting shaft; and (e) a shift arm for transmitting the reciprocal movement of the sliding means to the pinion gear so as to move the latter for connection and disconnection of the starter motor and the engine.

12 Claims, 3 Drawing Sheets

STARTER FOR INTERNAL COMBUSTION ENGINE

BACKGROUND OF THE INVENTION 1.1 The present invention is related to a starter for starting an internal combustion engine. More precisely, the present invention is based on a starter comprising a starter motor for generating a torque for rotating a crankshaft of the engine and a shift motor for connecting and disconnecting the starter motor to the crankshaft. The present invention is intended to compactize the starter while realizing a quick, smooth and reliable operation of the starter.

1.2 Prior Arts

Conventional starter is typically constructed and operated as follows.

A shaft of a starter motor extrudes from a motor body and a pinion gear is splined to the shaft through a one-way transmission mechanism so as to slide along the shaft and rotate uni-directionally. The pinion gear engages meshingly with a ring gear which is connected to an engine when the pinion gear is at a geared position. When the pinion gear is at a detached position, the pinion gear is detached from the ring gear. The one-way transmission mechanism transmits rotation of the starter motor to the engine but does not transmit rotation of the engine to the starter motor.

Position of the pinion gear is shifted selectively by means of a shifting arm which is activated by a magnetic switch and a plunger connecting them together.

In such a case, driving force shifting the pinion gear varies according to the position of the pinion gear because of a geometrical feature of the magnetic switch, and the shift arm often thrusts the pinion gear to come in contact with the ring gear strikingly. The gears are apt to be damaged, consequently. Further, relatively large electric current is required for activating the magnetic switch.

In order to avoid above-mentioned inconvenience, there are another type of starters which are provided with a shifting motor instead of the magnetic switch for activating the shift arm, an example is disclosed by Japanese Utility Model Application laid open with No. 60-30364. In the invention, a shifting motor comprises a shifting motor shaft extruding out of a motor body and spline cogs are formed in the shaft. A slider gears into the cogs of the shaft so that it moves along the shaft according to a rotation of the shaft. The slider holds an end of a shift arm, the other end of which being connected to the pinion gear for shifting the latter according to a rotational movement of the shifting motor.

A problem as to this starter is that a reaction force which is not parallel to the shifting motor shaft is exerted to the shaft by the shift arm, consequently, a bending moment is exerted to the shaft obstructing a smooth rotation of the shaft and the shifting motor. As a result, a larger shifting motor is needed to overcome the reaction force. The situation is improved when a distal end of the shifting motor shaft is supported by a bearing means such as a roller bearing. In the case, the non-axial reaction force is received both by the shifting motor and the bearing. Therefore, the reaction force exerted to the motor is reduced by half. But the abovementioned construction is not still enough to reduce drastically the non-axial force acting on the shaft of the shifting motor. As a result, shifting action is not smooth, quick, or certain. Furthermore, the shifting motor and an electric supply system for the motor become large in order to secure a necessary driving force.

SUMMARY OF THE INVENTION

Object of the Invention

In the light of the above-mentioned inconveniences and problems residing in conventional starters, an object of the present invention is to provide a starter which ascertains a quick, smooth and certain shifting action.

Another object of the present invention is to provide a starter which is more compact than conventional ones while maintaining same functions.

Another object of the present invention is to provide a more reliable starter wherein collision of gears under an excessive thrust force is avoided.

Other objects and effects of the present invention will become clear by the following description wherein the attached drawings are referred to.

Structural Framework of the Invention

In order to realize the above-mentioned objects, a starter according to the present invention comprises a sliding support helically splined to the shaft of the shifting motor. The sliding support is constructed not to transmit a component of a reaction force in a transversal direction, with respect to the shifting motor shaft. The sliding support transmits a component only in a longitudinal direction to the shifting motor shaft. Because the transversal reaction forces are not transmitted, the shifting motor shaft is free from bending moments. Thus the shifting action becomes quick, smooth and certain even when the torque of the shifting motor is small.

More precisely, a starter according to the present invention comprises:

(a) a starter motor having a starter shaft;

(b) a pinion gear splined to the starter shaft so as to be slidable along the starter shaft for connection and disconnection of the starter motor to the engine (c) a shifting motor having a shifting shaft;

(d) a sliding means helically splined to the shifting shaft;

(e) a shift arm for transmitting the sliding movement of the sliding means to the pinion gear so as to move the latter for connection and disconnection of the starter motor to the engine.

DETAILED DESCRIPTION OF THE PREFERRED EMBODIMENTS OF THE INVENTION

Construction of the Preferred Embodiments

Preferred embodiments of the present invention will now be explained hereinafter referring to the attached drawings.

Figure 1:
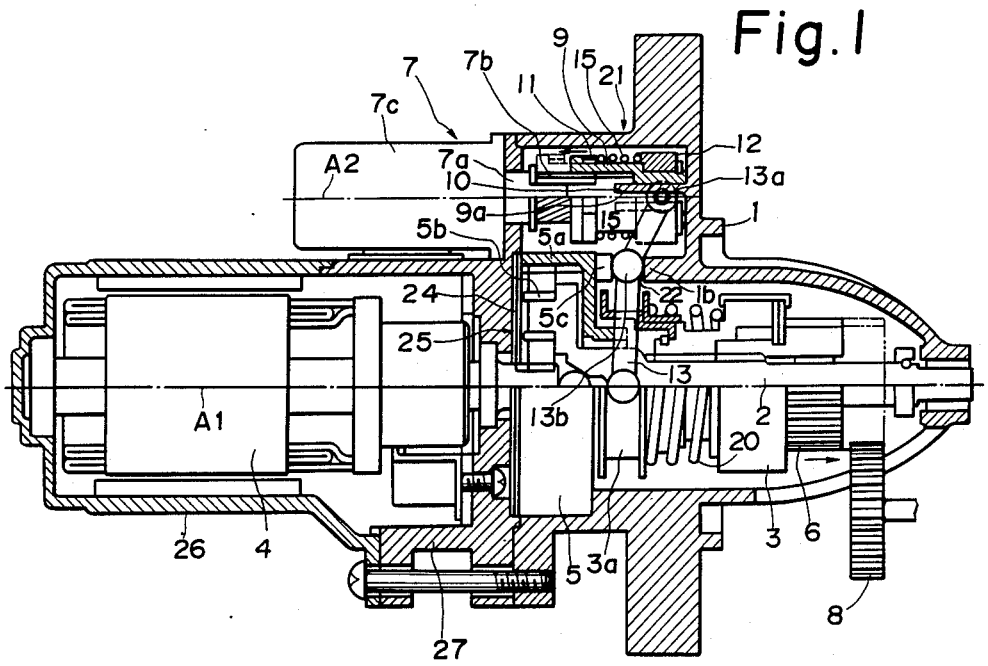
FIG. 1 shows a partially cut-off view of a starter according to an embodiment of the present invention.

FIG. 1 shows a preferred embodiment of a starter according to the present invention. A ring gear 8 is connected to an engine (not shown). A pinion gear 6 is splined to and supported coaxially by a gear shaft 2 which is connected to a first shaft 4a of a starter motor 4 so as to be slidable horizontally (in the drawings) along the gear shaft. Axes of the gear shaft 2 and the first shaft 4a coincide with a first axis A1. The pinion gear 6 comes geared with the ring gear 8 for transmitting a rotation of the starter motor 4 when the pinion gear 6 is located at a right-end position. When the pinion gear 6 is at a left-end position, the pinion gear 6 comes out of contact with the ring gear 8. The pinion gear 6 is held by a one-way transmission mechanism 3 which transmits rotational movement from left side to right side. In other words, the one-way transmission 3 transmits a rotational force of the starter motor 4 to the pinion gear 6 and thus to the engine while not transmitting rotational force of the engine to the starter motor. A first coil spring 20 is attached to the left side of the one-way transmission 3 at an end. The other end of the first coil spring 20 is connected to an arm receiver 3a. The distance between the arm receiver 3a and the one-way transmission 3 is determined by the first coil spring 20. Therefore, the distance may decrease when the one-way transmission receives an axial force tending to compress the first coil spring 20. The pinion gear 6, the one-way transmission 3, the first coil spring 20, and the arm receiver 3a are disposed coaxially to the gear shaft 2 and slidable along the shaft 2. A planet gear mechanism 5 having a gear housing 5a and planet gears 5b is disposed between the one-way transmission 3 and the first shaft 4a for transmitting rotation of the first shaft 4a to the gear shaft 2 while gearing down a rotation of the first shaft 4a. Thus, rotation of the starter motor 4 is transmitted to the pinion gear 6 through the planet gear mechanism 5, one-way transmission 3 and the gear shaft 2. The arm receiver 3a, the first coil spring 20 and the one-way transmission 3 contribute to determine a position of the pinion gear 6 along the first axis A1.

The above-mentioned members and mechanisms except for the starter motor 4 are enclosed by an enclosure 1. The starter motor 4 is enclosed in a yoke 26 and a bracket 27 which are connected to the enclosure 1 by means of bolts threading them together. A ring insert 24 and a rubber bushing 25 are inserted between the planet gear mechanism 5 and the bracket 27 so as to give a resilience between them.

A shifting motor 7 is provided so that an axis thereof, a second axis A2, is parallel to the first axis A1. The shifting motor 7 comprises a second shaft 7a extruding from a motor body 7c in which helically splined cogs 7b are formed. A sliding support 21 comprising a slider body 9, a stopper ring 11, a second coil spring 15 and a cylinder holder 12 holds the second shaft 7a. The slider body 9 is splined to the second shaft 7a for a movement along the second axis A2 according to a rotational movement of the second shaft 7a. Above-mentioned members and the mechanisms, except for the shifting motor 7, are also enclosed in the enclosure 1.

Figure 2:
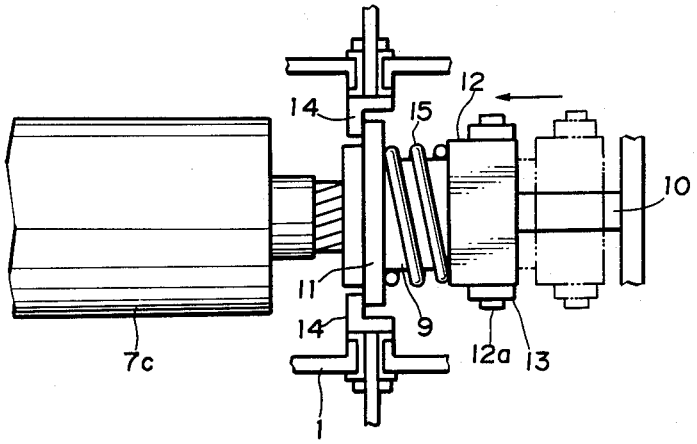
FIG. 2 shows a close-up view of a sliding support and a shifting motor comprised in the above embodiment.

As shown in FIG. 2, the stopper ring 11 comes in contact with the end terminal 14 which is supported from the enclosure 1 when the sliding support 21 is at a left-end position. The distance from the stopper ring 11 to the cylinder holder 12, which is slidable along the slider body 9, is determined by the second coil spring 15. Thus, the stopper ring 11, the second coil spring 15 and the cylinder holder 12 slides along the second axis A2 according to a rotational movement of the second shaft 7a.

An aperture 22 is formed between a separation wall 1b separating the sliding support 21 from the arm receiver 3a and a housing 5a of the planet gear mechanism 5. A shifting arm 13 passes through the aperture 22. One end, a first end, of the shifting arm 13 is attached to the abutment 13a of the sliding support 21 so as to swing about the abutment 13a; the other end, a second end, of the shifting arm 13 is received by the arm receiver 3a rotatable and slidable within a groove formed therein; and an fulcrum member 13b is supported rotatable between the separation wall 1b and a projection 5c projecting from the housing 5a into the aperture 22. The shift arm 13 swings about the fulcrum 13b according to an axial movement of the sliding support 21 to move reciprocally the arm receiver 3a along the first axis A1.

Figure 3:
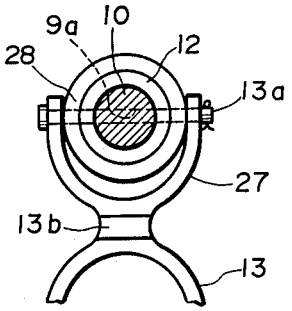
FIG. 3 to FIG. 5 show sectional views seen from an axial direction of a sliding member and a guide member.
Figure 4:
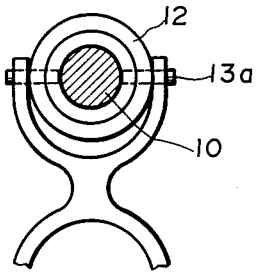

FIGS. 3 and 4 show variations of the mechanism connecting the sliding support 21 and the shift arm 13.

In FIG. 3, a support shaft 10 extends from the housing 1 toward the shifting motor 7 along the second axis A2. The sliding body 9 of the sliding support 21 is disposed coaxially to hold the support shaft keeping sliding contact with it. A through-hole 9a is formed to pass through the the sliding body 9 and the cylinder holder 12 intersecting perpendicularly the second axis A2. A slit is formed in the support shaft 10 in a plane including the second axis A2 and the through-holes 9a. The shift arm 13 splits into a pair of guide arms 13c from the fulcrum 13b. A junction bar 28 connects opposing distal ends of the guide arms 13c passing through the through-hole 9a of the sliding support and the slit of the support shaft 10. The junction bar 28 permits a rotational movement of the guide arms 13c about itself while eliminating a relative movement along the second axis A2 and a relative rotation about the second axis. Thus the shift arm 13 swings about the fulcrum 13b according to a sliding movement of the sliding support induced by a rotational movement of the second shaft 7a.

In an embodiment shown in FIG. 4, a pair of holes 12a are formed in the cylinder holder 12 and a pair of junction bars 28 which are supported by a pair of respective guide arms 13c are inserted therein. Relative movement of the shift arm 13 and the sliding support 21 in an axial direction is eliminated while permitting a relative rotation thereof about the junction bars 28.

In a further modified embodiment, a pair of abutments 12a project radially outward from the cylinder holder 12 in opposite directions. The abutments 12a are received by as many grooves (not shown) formed in the enclosure 1 so that the sliding support 21 may slide along the second axis A2 while the abutments 12a keep contact with walls defining the groove.

Figure 5:
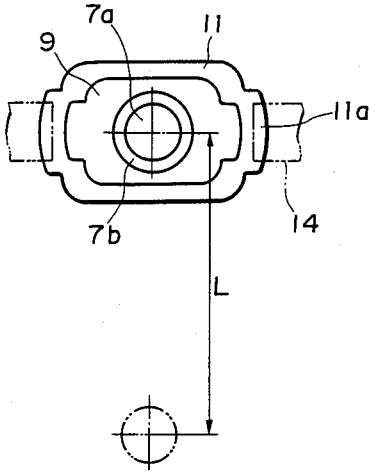

FIG. 5 is a sectional view of the sliding support 21 and the second shaft 7b cut at a plane perpendicular to the second axis A2. The figure shows that the sliding body 9 meshes with the helically splined second shaft 7a and a pair of projections 11a come in contact with the terminal plates 14.

Operation of the Preferred Embodiments

Ordinarily, while neither the starter nor the engine is in action, the sliding support 21 is at a right-end position, the arm receiver 3a is at a left-end position, and the pinion gear 6 is out of meshing position with the ring gear 8. When starting the engine, the shifting motor 7 rotates to slide the sliding support 21 leftwards, to swing the shift arm 13 in an anti-clockwise direction in FIG. 1, to slide the pinion gear 6 rightwards. Consequently, the pinion gear 6 comes geared with the ring gear 8. Then, the starter motor 4 is activated to start the engine. When the engine is get started, the starter motor 4 is inactivated and then the shifting motor rotates in an opposite direction as before so as to extract the pinion gear 6 out of the geared position with the ring gear 8. As the sliding support 21 is helical splined to the second shaft 7*a*, movement of the pinion gear 6 can be made enough quick without requiring an excessively large torque of the shifting motor 7 by choosing properly the pitch of the spline. The shift arm 13 receives a reaction force from the arm receiver 3*a* and exerts a reaction force to the sliding support 21. The reaction force is large especially when the pinion gear 6 does not come into meshing position with the ring gear 8 irrespective of the thrust force exerted by the one-direction transmission 3. The reaction force exerted to the sliding support 21 does not include a transversal component being perpendicular to the second axis A2 in a plane defined by the first axis A1 and the second axis A2. Therefore, only the axial component of the reaction force is transmitted to the shifting motor 7. Even if a transversal component is included in the reaction force, the component is received by the support shaft 10 Thus, rotation of the shifting motor 7 becomes smooth under a minimum torque. The fulcrum member 13*b* rotates within the aperture 22 as the sliding support 21 slides along the second axis A2. The resilience of the first coil spring 20 act as buffer to absorb an impact force which may be generated when the pinion gear 6 comes in contact with the ring gear 8. The ring insert 24 and the rubber bushing 25 further moderates the impact force.

Further Modified Embodiments

In order to activate the starter motor 4 when the pinion gear 6 comes geared with the ring gear 8, the terminal plates 14 may serve as a switching device for the starter motor 8. In a modified embodiment, electricity is supplied to the starter motor 4 as the terminal plates 14 is electrically connected to each other by means of the stopper ring 11. In the embodiments, the projections 11*a* are disposed so that the axis passing the both projections 11*a*. is perpendicular to a plane defined by the first axis A1 and the second axis A2. By virtue of the above-mentioned disposition, distance of the starter motor 4 and the shifting motor 7 is minimized, consequently compacting starter.

In a further modified embodiment, the starter further comprises a control unit which controls the operation of the starter as follows.

The control unit, activated by a start signal, first activates the shifting motor 7 for shifting the sliding support 21 to the left-end position. Consequently, the pinion gear 6 is thrusted toward the ring gear 8 by means of a swing motion of the shift arm 13 and comes in meshing contact with the ring gear 8. Then, the shifting motor 7 is inactivated to hold the position and the starter motor 4 is activated to start the engine. When the engine starts, according to a termination of the start signal, the start motor 4 is inactivated, and the shifting motor 7 is activated to rotate in a reverse direction for withdrawing the pinion gear 6 out of a meshing position with the ring gear 8. Then, the shifting motor 7 is inactivated, thus closing a start procedure of the engine.

Figure 6:
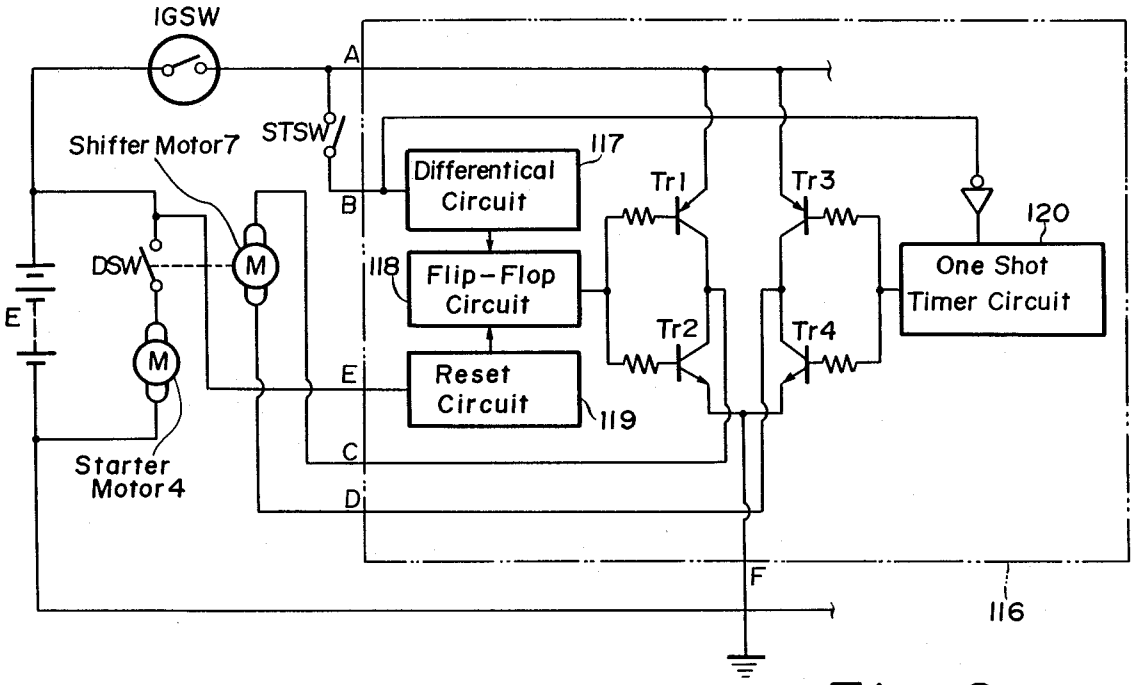
FIG. 6 shows a flow diagram showing schematically an electrical construction of an embodiment of the present invention.

The embodiment is explained more in detail referring to a flow diagram shown in FIG. 6.

As shown in FIG. 6, the control unit 116 and other electric equipments are activated by switching on a ignition switch IGSW. A starter switch STSW, a second switch DSW and motors are connected electrically to the control unit 116 through terminals A–F.

When starting the engine, the ignition switch IGSW is set on and subsequently the starter switch STSW is set on. Then, an electric current is supplied to the control unit 116, a differential circuit 117, and a flip-flop circuit 118 switching on a transistor TR1 and switching off a transistor TR2. By this operation, an electric current is supplied to a circuit comprising the ignition switch IGSW, a terminal A, the transistor TR1, a terminal C, shifting motor 7, a terminal D, a transistor Tr4, a terminal F, and the earth. The shifting motor 7 is activated to move the sliding support 21 toward itself until the stopper terminals 14 are connected to each other by the stopper ring 11 and the pinion gear 6 comes in geared position with the ring gear 8.

Then, the second switch DSW is brought into an activated position to activate the starter motor 4. The second switch DSW is connected to a Reset Circuit in the control unit 116. The voltage at a terminal E decreases together with the activation of the starter motor 116, consequently the reset circuit 119 resets the Flip-Flop circuit 118, that is, the transistor TR1 is set off, the transistor TR2 is set on, and the electric supply to the shifting motor is cut off.

Thus, the engine is started by the start signal emitted by the starter switch STSW.

Then, the starter switch WTSW is set off by a driver when a start of the engine is recognized. The control signal is transmitted to the one-shot timer circuit 120 which sets on a transistor TR3 and set off the transistor TR4. Consequently, an electric current is supplied to the terminal A, transistor TR3, terminal D, shifting motor 7, terminal C, transistor TR2, and terminal F, thus rotating the shifting motor in a reverse direction as before. The pinion gear 6 gets out of the meshing position with the ring gear 8, the second switch DSW is set off, and the starter stops the operation.

As above-mentioned, according to the embodiment, the shifting motor 7 is activated according to a start signal of the starter switch STSW, the starter motor is activated just when the pinion gear 6 becomes meshed with the ring gear 8, the shifting motor 7 is inactivated while the starter motor 4 is rotating, and the shifting motor 7 is activated again to return the pinion gear 6 to the first position according to a switch off signal of the starter switch STSW. Shifting and rotation of the pinion gear 6 is performed smoothly without loosing time between succeeding operations. Furthermore, the motors are activated only when the pinion gear 6 is to be shifted or rotated. In other words, activation of motors while holding the shaft motionless, which is sometimes the case in conventional starters, is avoided. Thus a redundant capacity of the shifting motor 7 can be eliminated. Generation of disadvantageous heat by the shifting motor is avoided also. Therefore, increases the efficiency and the reliability of the mechanism.

Effect of the Invention

Because the movement of the sliding support is smooth in any operational conditions, the torque required to the shifting motor becomes small resulting in a compact and less costly starter.

Operation of the starter according to the present invention is swift, smooth and certain by virtue of a smooth and certain operation of the sliding support.

Further, because striking contact of gears and exertion of excessive driving force to the gears is avoided, reliability of the mechanism including the pinion gear and the ring gear is improved.

What is claimed is:

1. A starter for starting an internal combustion engine which comprises:

(a) a starter motor having a starter shaft;

(b) a pinion gear splined to the starter shaft so as to be slidable along the starter shaft for connection and disconnection of the starter motor to the engine;

(c) a shifting motor having a shifting shaft;

(d) a stationary support member provided co-axially with the shifting shaft;

(e) a sliding means helically splined to the shifting shaft and slidable along said stationary support member keeping sliding contact therewith; and (f) a shift arm for transmitting the sliding movement of the sliding means to the pinion gear so as to move the latter for connection and disconnection of the starter motor to the engine.

2. A starter for starting an internal combustion engine according to claim 1, wherein (a) said pinion gear is slidable along the starter shaft between a meshing position wherein the pinion gear is connected meshingly with a ring gear connected to the engine and an non-meshing position wherein the pinion gear is disconnected from the ring gear, and rotate together with the main shaft;

(b) the sliding means reciprocates between a first position and a second position according to a rotational movement of the shifting shaft; and (c) the shift arm is pivotally supported at a mid-part thereof, connected drivingly to the sliding means at a proximate end thereof, connected pivotally and slidably to the pinion gear at a distal end thereof, whereby the shift arm shifts the pinion gear to the meshing position when the sliding means is at the second position so that rotational force of the starter motor is transmitted to the engine for starting it, the shift arm shifts the pinion gear to the nonmeshing position when the sliding means is at the first position so that rotational force of the engine is not transmitted to the starter motor.

3. A starter for starting an internal combustion engine according to claim 1, wherein a guide means is provided to the sliding support said guide means comprising a pair of projections, and a pair of grooves formed in said sliding means along a direction of said shifting shaft so as to receive respective projections, whereby radial and rotational movement of the sliding means is restricted by the engagement of the grooves and the projections.

4. A starter for starting an internal combustion engine according to claim 1 or 2, wherein (a) said shift arm is split into two a pair of guide arms;

(b) a slit is formed in the stationary support member;

(c) a through-hole is formed in a sliding support;

(d) a holding member connects the sliding support and the shift arm by threading them whereby a movement of the sliding support is transmitted to the pinion gear while only a rotational movement about the holding member is permitted.

5. A starter for starting an internal combustion engine according to claim 1 or 2, wherein said pinion gear is enclosed in a main enclosure having an aperture through it, and said shift arm passes through the aperture and is pivotally supported at its mid-part by a pair of opposing walls defining the aperture.

6. A starter for starting an internal combustion engine according to claim 1 or 2 which further comprises a switch means which is at a connected position for activating said starter motor to start said engine when the sliding means is at said second position, and at a disconnected position for inactivating the starter motor when the sliding means is at said first position.

7. A starter for starting an internal combustion engine according to claim 6, wherein said switch means comprises a pair of outer terminals located in a spaced relation to said sliding means separately from each other, and an electrically conductive connector means having a pair of inner terminals disposed on the sliding means, whereby an electric circuit is completed when the sliding means takes said second position as the pair of outer terminals are electrically connected to each other through the pair of inner terminals and the electrically conductive connector means.

8. A starter for starting an internal combustion engine according to claim 7, wherein said electrically conductive connector means is said sliding means itself.

9. A starter for starting an internal combustion engine according to claim 7, wherein said outer terminals and said inner terminals are disposed in a plane including said shifting shaft and perpendicular to a plane defined by said shifting shaft and said starter shaft.

10. A starter for starting an internal combustion engine according to claim 8, wherein said outer terminals and said inner terminals are disposed in a plane including said shifting shaft and perpendicular to a plane defined by said shifting shaft and said starter shaft.

11. A starter for starting an internal combustion engine according to claim 1 or 2 which further comprises a control means which sends a control signal to said shifting motor so as to shift said sliding means toward said second position according to an engine start signal from a driver, and subsequently annul the control signal so as to inactivate the shifting motor.

12. A starter for starting an internal combustion engine which comprises:

(a) a starter motor having a starter shaft;

(b) a pinion gear splined to the starter shaft so as to be slidable along the starter shaft for connection and disconnection of the starter motor to the engine;

(c) a shifting motor having a shifting shaft;

(d) a sliding means helically splined to the shifting shaft for a reciprocal movement along the shifting shaft according to a rotational movement of the shifting shaft;

(e) a shift arm for transmitting the reciprocal movement of the sliding means to the pinion gear so as to move the latter for connection and disconnection of the starter motor and the engine; and (f) a control means which sends a control signal to said shifting motor so as to shift said sliding means toward a start-up position, wherein said pinion gear connects the starter motor to the engine, according to an engine start signal from a driver, and subsequently annul the control signal so as to inactivate the shifting motor.

* * * * *